US007380432B2

(12) United States Patent
Segal

(10) Patent No.: US 7,380,432 B2
(45) Date of Patent: Jun. 3, 2008

(54) METHOD AND APPARATUS FOR EQUAL CHANNEL ANGULAR EXTRUSION OF FLAT BILLETS

(75) Inventor: Vladimir M. Segal, Howell, MI (US)

(73) Assignee: Engineered Performance Materials Co., LLC, Whitmore Lake, MI (US)

( * ) Notice: Subject to any disclaimer, the term of this patent is extended or adjusted under 35 U.S.C. 154(b) by 0 days.

(21) Appl. No.: 11/702,829

(22) Filed: Feb. 6, 2007

(65) Prior Publication Data

US 2007/0131013 A1 Jun. 14, 2007

Related U.S. Application Data

(62) Division of application No. 10/866,548, filed on Jun. 14, 2004, now Pat. No. 7,191,630.

(60) Provisional application No. 60/489,742, filed on Jul. 25, 2003.

(51) Int. Cl.
*B21C 35/00* (2006.01)

(52) U.S. Cl. ..... 72/257

(58) Field of Classification Search ..... 72/253.1, 72/257, 270, 272, 273
See application file for complete search history.

(56) References Cited

U.S. PATENT DOCUMENTS 3,126,097 A 3/1964 Sejournet
3,191,413 A 6/1965 Stulen
3,271,986 A 9/1966 Stulen
3,592,032 A * 7/1971 Stromblad ..... 72/21.5
3,907,069 A 9/1975 Pryor et al.
5,400,633 A * 3/1995 Segal et al. ..... 72/272
5,513,512 A 5/1996 Segal
5,600,989 A 2/1997 Segal et al.
5,850,755 A 12/1998 Segal
6,723,187 B2 4/2004 Segal et al.
6,878,250 B1 * 4/2005 Segal et al. ..... 204/298.13
6,883,359 B1 4/2005 Hartwig, Jr.
6,976,380 B1 * 12/2005 Hartwig et al. ..... 72/253.1
7,117,704 B2 * 10/2006 Ogura et al. ..... 72/255

* cited by examiner

*Primary Examiner*—Ed Tolan
(74) *Attorney, Agent, or Firm*—Richard W. Hoffmann; Reising Ethington Barnes Kisselle PC

(57) ABSTRACT

The invention comprises a method and apparatus for equal channel angular extrusion (ECAE) of flat billets to control material structure and properties. The improvements of the method include the special systems of billet orientations, billet lubrication, billet ejection from dies, and a press/die control system those eliminate surface cracks, flashes and billet reshaping or deburring between passes. Therefore, multi-pass ECAE becomes a cost-effective industrial operation and may be applied to large billets.

5 Claims, 7 Drawing Sheets

METHOD AND APPARATUS FOR EQUAL CHANNEL ANGULAR EXTRUSION OF FLAT BILLETS

RELATED APPLICATION

This application is a divisional of and claims priority in and benefit of U.S. application Ser. No. 10/866,548 filed Jun. 14, 2004 now U.S. Pat. No. 7,191,630 which claims priority in and benefit of U.S. Provisional Application No. 60/489,742 filed Jul. 25, 2003, both of which are incorporated herein by reference.

BACKGROUND OF THE INVENTION

1. Field of the Invention

The present invention relates to the plastic deformation of flat billets and more specifically to method and apparatus for equal channel angular extrusion (ECAE) of flat billets to control material structure, texture and physical-mechanical properties.

2. Description of the Prior Art

Historically, the primary goal of metalworking was to change billet shapes and dimensions. Thus, various forming operations such as forging, rolling, extrusion, etc. were developed. Simultaneously, plastic deformation has been recognized as an effective method for structure alteration and properties improvement of different metals and alloys. However, the conventional forming processes are not optimal to control material structures because of multiple reductions of a billet cross section, high pressures and loads, complicated machines and expensive tool which are necessary to attain high strains. The situation was dramatically changed after the applicant introduced materials processing by simple shear without any change of the billet cross-section. This technique known as equal channel angular extrusion (ECAE) comprises lateral billet extrusion between two intersecting channels of identical cross-sections. The method was first disclosed in the Invention Certificate of the USSR No 575892 of Oct. 22, 1974 and was described in other patents and publications (see, for example, Segal, U.S. Pat. No. 5,513,512, 1996; V. M. Segal et al "Plastic Working of Metals by Simple Shear". English translation: "Russian Metallurgy", No 1, pp. 99-105, 1981; V. M. Segal, "Materials Processing by Simple Shear", "Mat.Sci&Eng.", A 197, pp. 157-164, 1995). Multi-pass ECAE with special systems of billet orientation between passes allows one to accumulate severe strains and to optimize processing that provides unusual structural effects: grain refinement to sub-micron, sometimes to nano scale; refinement of second phases, hard particles, inclusions and precipitates; control of crystallographic textures and grains/phases aspect ratios; enhanced diffusivity and superplasticity; consolidation and bonding of powders; breakdown of cast structures; etc.

Originally, ECAE was introduced for long billets. Later, in the U.S. Pat. No. 5,850,755, 1998, the applicant also suggested ECAE of flat billets (FIG. 1). The last invention presents significant practical interest as it may be applied for fabrication of plates, sheets, strips and similar products. However, to make ECAE cost effective in high volume production and for massive billets, some problems of the technology should be resolved.

First, as that was described in the U.S. Pat. No. 5,850,755, the optimal ECAE of flat billets requires their rotation 90 degrees about a perpendicular axis to a billet flat surface after each pass. Therefore, punch impressions at this surface are mutually perpendicular (FIG. 2). These impressions reflect sharp changes of extrusion directions and grain orientations. That develops large local stresses near areas "A" of their intersections and may result in deep cracks during multi-pass processing.

Second, the prior art does not provide simple and effective means for billet ejection from the ECAE die. An extended contact area and high friction into the second channel requires a large ejection force to move the billet along the channel. That results in unreliable ejectors and complicated tool (see, for example, U.S. Pat. No. 5,85,755).

Third, contact friction into the first channel also presents a problem. The normal pressure on channel walls is proportional to friction coefficient and usually exceeds the material flow stress a few times even with the best lubricants. For large billets, the situation is more complicated because lubricant is carried away during a long stroke. In these cases, the ECAE die should be sufficiently strong, massive and expensive.

Forth, each pass of ECAE changes slightly a billet shape and may introduce flashes along a punch and movable die parts. Thus, some billet reshaping and debburing of flashes are necessary to insert the billet into the die and to eliminate laps, surface cracks and other defects. These operations are time and labor consuming, especially for large billets and warm/hot processing conditions.

SUMMARY OF THE INVENTION

An object of the present invention, therefore, is improvements of ECAE of flat billets having a large ratio of longitudinal billet dimensions to the billet thickness, comprising the steps of lubricating a billet, inserting the billet in the first channel, extruding the billet into the second channel, ejecting the billet from the second channel, changing the billet orientation, and repeating the foregoing steps.

One embodiment of the invention is a method of multi-pass ECAE in which changing the billet orientation after each pass comprises two step rotating: (i) 180 degrees about one of longitudinal billet axes and (ii) 90 degrees about a perpendicular axis to a billet flat surfaces. The method eliminates surface cracks and improves material uniformity.

Another embodiment of the method is that the step of rotating 90 degrees about the perpendicular axis to the billet flat surface is performed alternatively into clockwise and anticlockwise directions between successive passes to produce ultra fine and equiform structures.

Further embodiment of the method is that the step of rotating 90 degrees about the perpendicular axis to the billet flat surfaces is performed into the same direction after each pass to produce maximum distortions of material elements and oriented structures.

Additional embodiment of the method is that the step of rotating 90 degrees about the perpendicular axis to the billet flat surfaces is performed required number of times with selected sequences into clockwise and anticlockwise directions to produce various structures.

Another embodiment of the invention is a method of ejecting the billet from ECAE dies in which a punch is operated by a press, the first channel is formed between a front plate, a back plate and two side plates, the second channel is formed between the same plates and a movable slider operated by a hydraulic cylinder, comprising the steps of performing a working punch stroke, performing a small retreating punch stroke, moving the slider into a direction of an original slider position until full opening of the second channel, performing an ejecting punch stroke, and returning punch and slider to their original positions. The method provides productive die operation and reliable billet ejection with the simple die.

Another embodiment of the invention is a method of lubricating flat billets in the first channel. The method comprises the step of forming of shallow lugs at billet flat surfaces during extruding the billet and the step of filling pockets between lugs by a viscous lubricant during the step of lubricating the billet. Low contact friction reduces the pressure on channel walls that results in simple and less expensive dies, especially for massive billets.

Next embodiment of the invention is a control system, which operates press and die and provides a correct flat billet shape without flashes and reshaping between passes. The control system comprises position sensors of punch and slider, and a programmable controller to correct the working punch stroke at each pass depending on statistical data obtained for the particular billet material, processing conditions, the pass number and press/die springing characteristics.

Another embodiment of the invention is a control system comprising position sensors of punch and slider, an adaptive controller and a punch pressure sensor to correct the working stroke at each pass depending on the punch pressure and press/die springing characteristics.

DETAILED DESCRIPTION OF THE INVENTION

Figure 1:
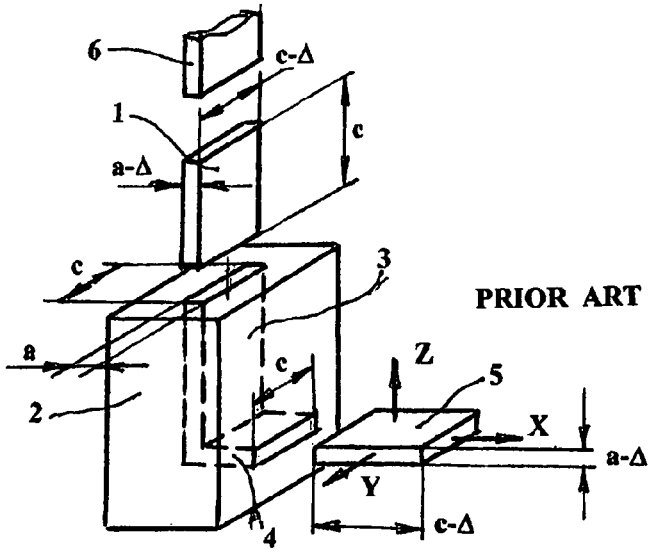
FIG. 1 is a view showing the prior art of ECAE of flat billets.

Now, of the invention will be described in details with reference to the accompanying figures. FIG. 1 illustrates schematically the ECAE process for flat billets as that was suggested by Segal. A well-lubricated billet 1 is placed into a die 2 comprising two intersecting channels 3,4 of identical cross section areas. ECAE is performed by a punch 6. To insert the billet into the die, thickness and width of the billet and the first channel 3 are (a-.DELTA.), (c-.DELTA.) and (a), (c), respectively (FIG. 1). That provides a small clearance .DELTA. between the billet and die walls. Correspondingly, thickness and width of the second channel 4 are (a-.DELTA.), (c). An extruded billet 5 has dimensions (a-.DELTA.), (c), (c-.DELTA.) and may be inserted into the first channel 3 without any machining or reshaping after rotation 90 degrees about a perpendicular axis Z to a billet flat surface. Therefore, according to the prior art, multi-pass ECAE of flat billets comprises the steps of lubricating, inserting into the first channel, extruding into the second channel, ejecting from the second channel, rotating 90 degrees about the perpendicular axis to the billet flat surface, and repeating these steps a required number of times.

Figure 2:
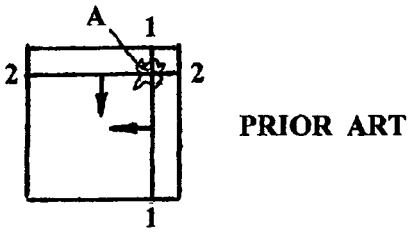
FIG. 2 is a plan view of punch impressions at the billet top surface in accordance with the prior art.
Figure 3:
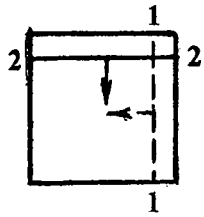
FIG. 3 is a plan view of punch impressions at the billet top surface in accordance with the present invention.

Referring now to FIG. 2, it is seen that, with the prior art, punch impressions 1-1 after the preceding pass and 2-2 after the following pass intersect with each other at the top billet surface. That develops high local stresses in an area A where the material experiences a sharp change of flow directions and grain orientations. During subsequent passes, these stresses may develop deep surface cracks. In accordance with the invention, additional steps of billet rotation 180 degrees about one of longitudinal axes X or Y after each pass solve this problem (FIG. 3). Because of this rotation, punch impressions 1-1 and 2-2 are located at top and bottom billet surfaces and do not intersect with each other. The sharp change of extrusion directions and grain shapes are spread through a billet thickness and does not lead to cracks.

Figure 4:
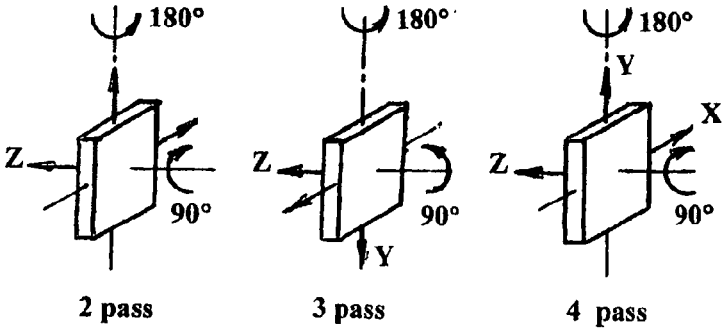
FIG. 4 shows a processing route to provide ultra fine, equiform grain structures.
Figure 5:
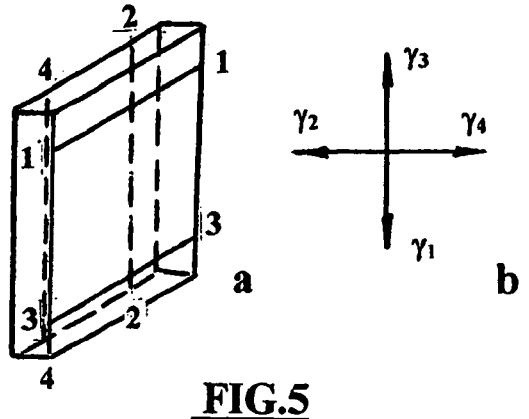
FIG. 5 is a three dimensional depiction of punch impressions (a) and accumulated shears (b) in billets for the processing route of FIG. 4.

The present invention also includes the special combinations of these rotations to control shear planes, shear directions and material distortions during multi-pass ECAE of flat billets. Referring to FIGS. 4, 5, it is seen that when rotations 90 degrees about the perpendicular axis Z to the billet flat surface are performed alternatively into clockwise and anticlockwise directions, 4 passes of ECAE introduce in the billet shears 1, .gamma..sub.2, .gamma..sub.3 and gamma..sub.4 which act along longitudinal billet axes into opposite directions and mutually compensate each other. That restores periodically original shapes of material elements after each fourth pass. It is known in the art that such processing route is the most effective for structure refinement to equiform and ultra fine grains.

Figure 6:
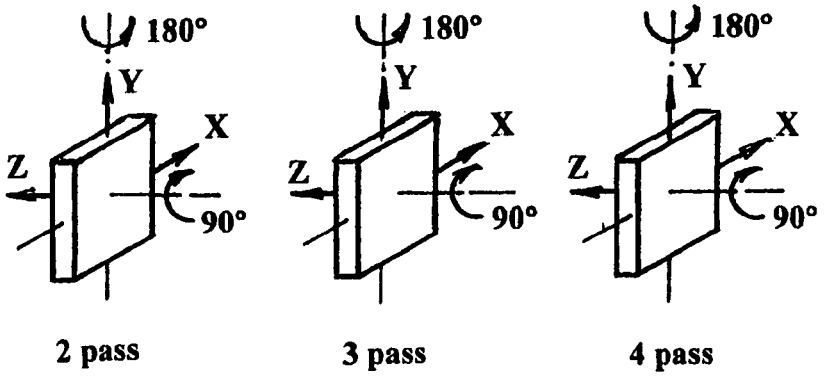
FIG. 6 shows a processing route to provide maximum distortions of material elements.
Figure 7:
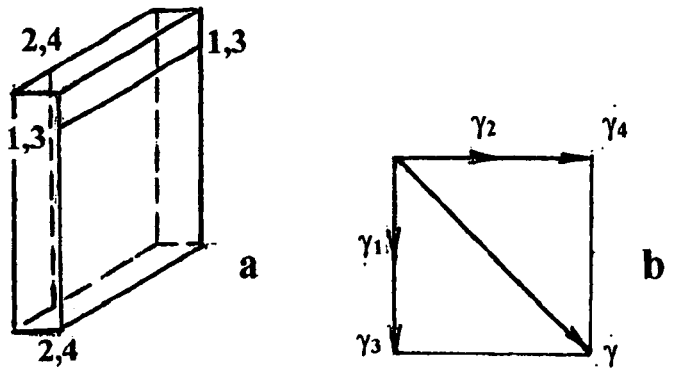
FIG. 7 is a three dimensional depiction of punch impressions (a) and accumulated shears in billets for the processing route of FIG. 6.

In other limit case (FIG. 6), rotations 90 degrees about the perpendicular axis Z to the billet flat surface are performed into the same direction. Corresponding shears .gamma..sub.1,.gamma..sub.3 and .gamma..sub.2,. gamma..sub.4 along longitudinal billet axes act into the same directions and are summarized. That results in the maximum accumulated shear gamma. and distortions of material elements (FIG. 7). Therefore, this processing route is optimal for fabrication of composites, material homogenization, consolidation of powders, breakdown of cast structures.

Numerous combinations of the two limit cases are also possible when rotations 90 degrees about the perpendicular axis Z to the billet flat surface after each pass are performed required numbers of times into clockwise and anticlockwise directions with selected sequences. Each of these combinations develops the specific system of shear planes, shear directions and material distortions, which may be optimal for particular problems.

Figure 8:
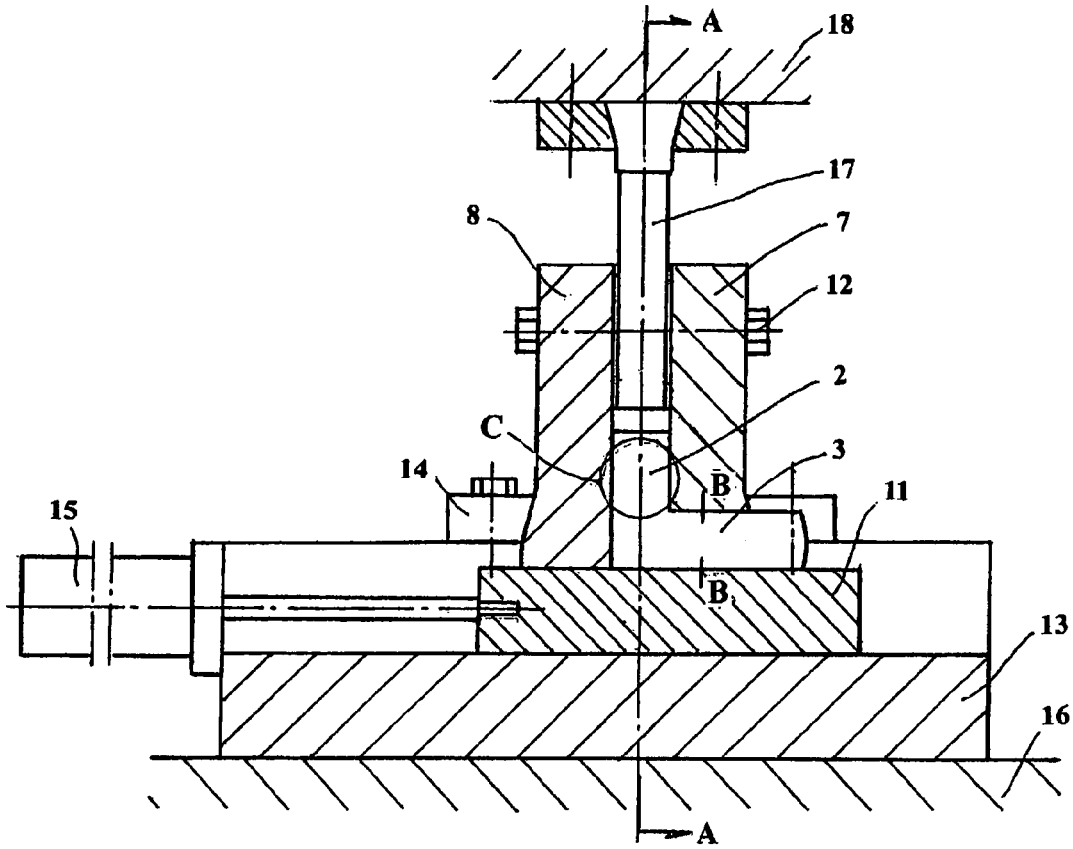
FIG. 8 shows a cross section view of an ECAE die for flat billets.
Figure 9:
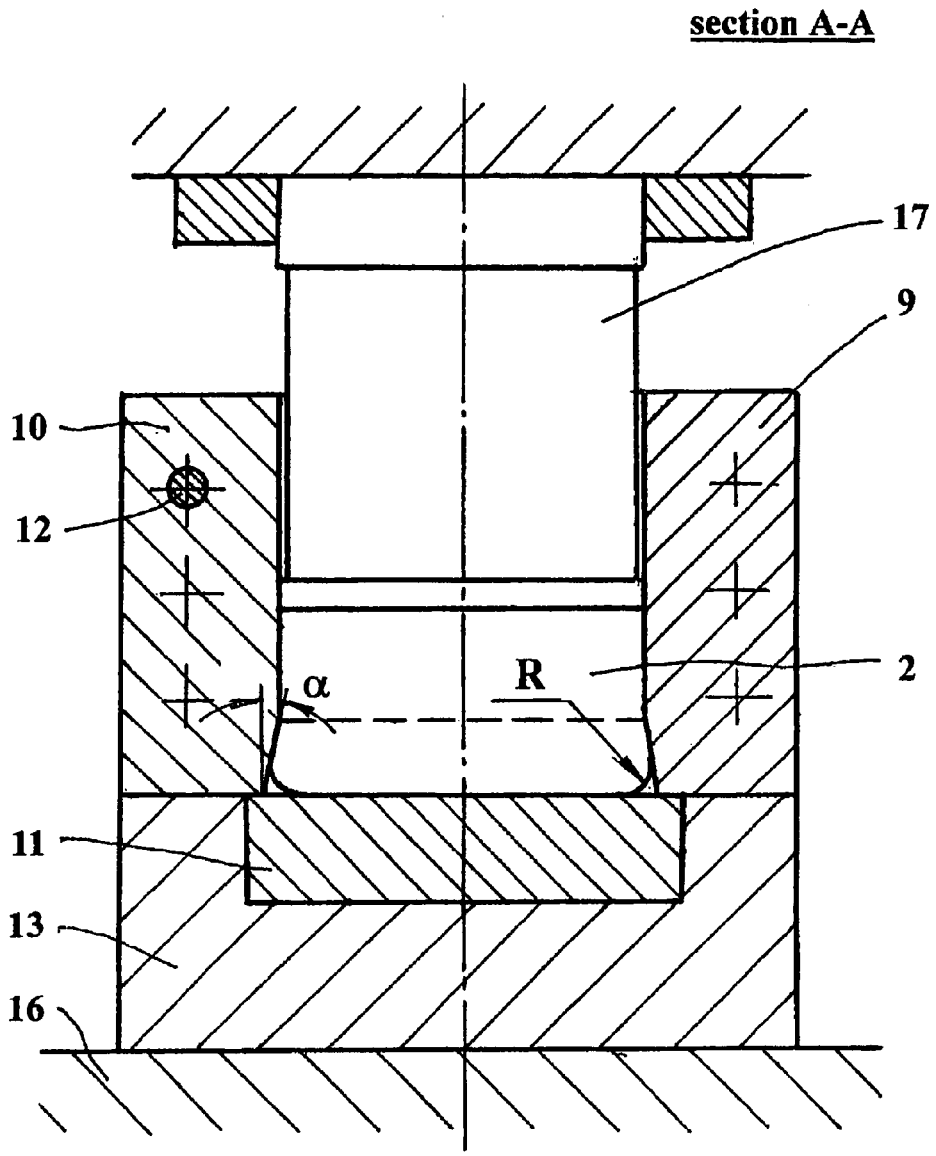
FIG. 9 is a cross-sectional view of section A-A of FIG. 8.
Figure 10:
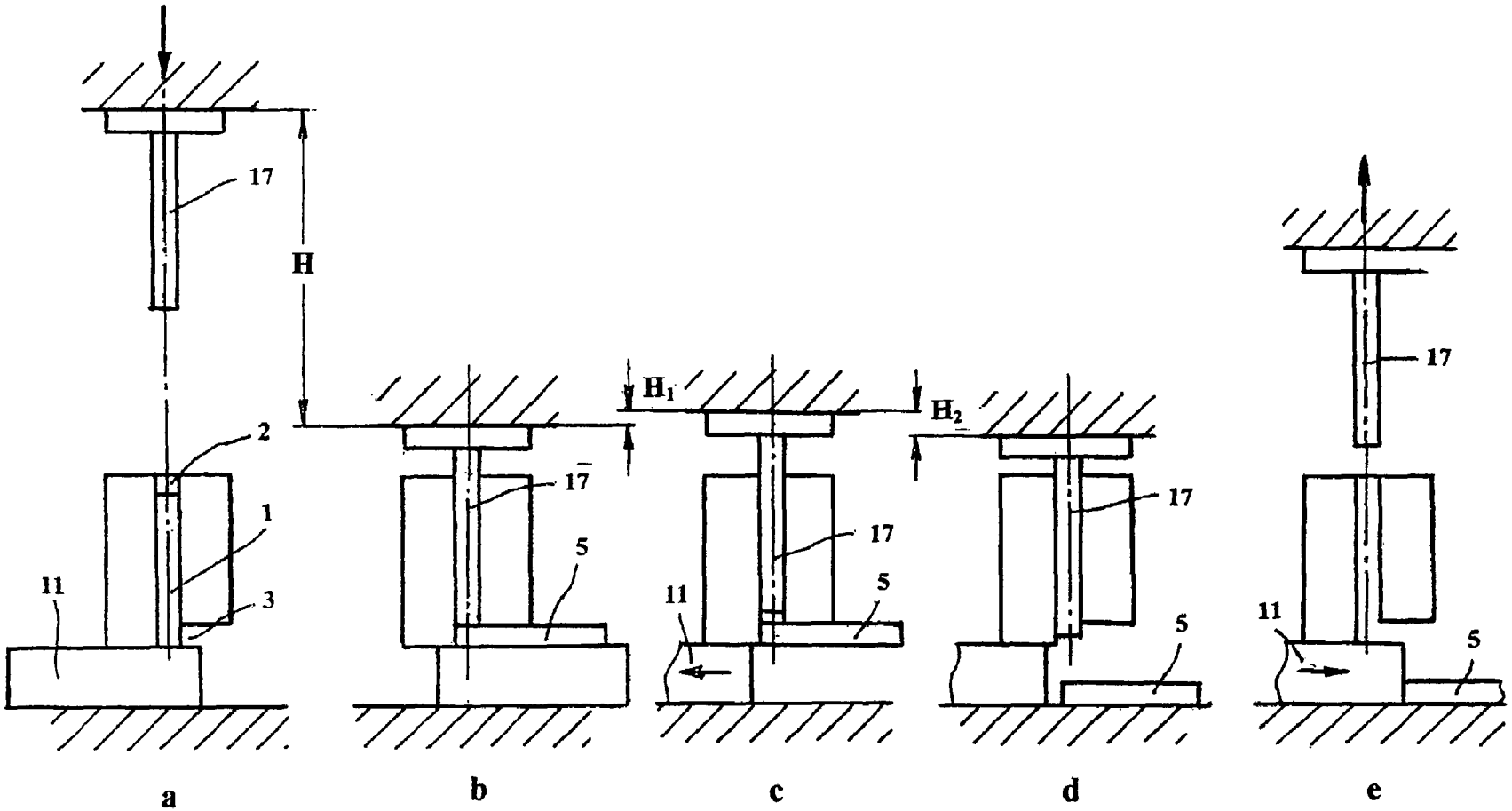
FIG. 10 is a diagram of processing steps for ejecting a billet during ECAE.

Referring now to FIGS. 8, 9, 10, the present invention presents a new method of ejecting a billet from an ECAE die. The die comprises channels 2,3 formed by a front plate 7, a back plate 8, two side plates 9,10 and a slider 11. Plates 7,8,9,10 are secured together by studs 12 and are fixed at a die base 13 by clamps 14. The slider 11 is operated by a cylinder 15 and moves inside the base 13. The die is mounted at the press 16. ECAE is performed by a punch 17 attached to a press traverse 18. FIG. 10 explains a die operation. In the original position a, the punch 17 is lifted up, the slider 11 covers partly the channel 3, and a billet 1 is inserted into the channel 2. During a working stroke H, the punch 17 extrudes the billet 1 into the second channel 3 and slider 11 moves together with an extruded billet 5 (position b). Then, the punch 17 performs a small retreating stroke H.sub.1 to release the billet 5 whereupon the slider 11 moves into a direction of the original slider position till full opening of the channel 3 (position c). After that, the punch 17 performs an ejection stroke H.sub.2 and ejects the billet 5 from the channel 3 (position d). Finally, punch 17 and slider 11 return to the original positions (position e) and the billet 5 is removed from the die.

To facilitate ejecting the billet, the side plates 9,10 are provided with draft angles .alpha. from 3 degrees to 12 degrees extended to the slider (FIG. 9). The draft angles reduce extrusion stroke and load, and eliminate flashes along a split surface between the slider and channels where large radii R are formed (FIG. 9). During multi-pass ECAE with a billet rotations 90 degrees about perpendicular axes to billet flat surfaces, these radii also prevent flashes between the punch 17 and the channel 2. Therefore, multi-pass ECAE does not require billet deburring and reshaping.

If there are no strong requirements on a billet shape after ECAE, the draft angles may be performed from 12 to 30 degrees. In such cases, a billet weight is sufficient for its removal from the die and the ejection punch stroke may be eliminated H.sub.2=0 whereas the retreating punch stroke is H.sub.1=H.

Figure 12:
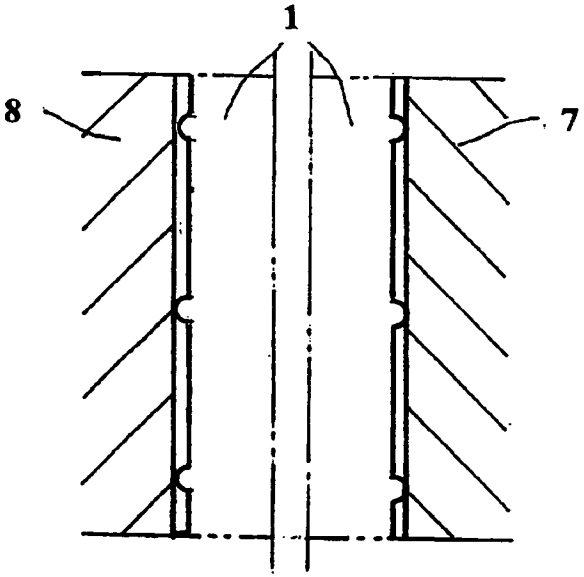
FIG. 12 is an enlarged view of the area "C" of FIG. 8.
Figure 11:
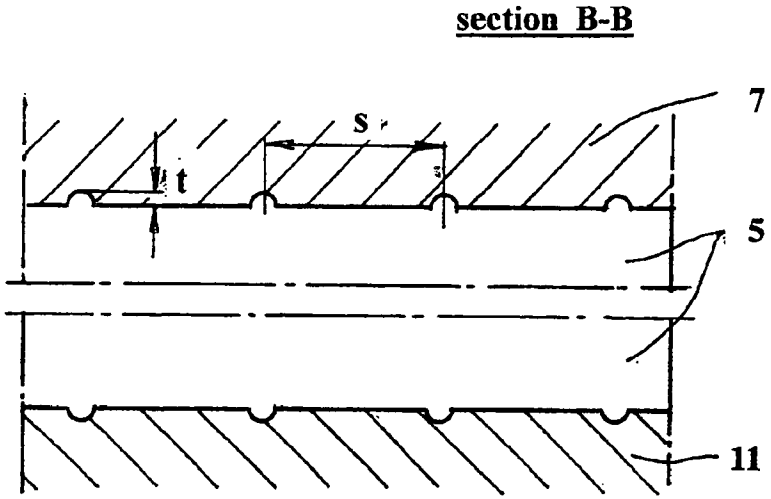
FIG. 11 is an enlarged cross-sectional view of section B-B of FIG. 8.

Referring further to FIGS. 8, 11, 12, the method of the invention also provides low contact friction in the first channel. This goal is attained by providing shallow grooves at a bottom surface of the front plate 7 and a top surface of the slider 11 as shown schematically in FIG. 11. Depending on a billet thickness (a), a depth of grooves (t) varies from 0.5 mm to a few millimeters while a spacing (s) ranges from 5 mm to 50 millimeters. For multi-pass ECAE, these grooves form continuous lugs at flat billet surfaces oriented into an extrusion direction. During the step of lubricating the billet, pockets between lugs are filled up with a viscous lubricant. At next processing pass, because of billet rotations, lugs take a transverse orientation to the extrusion direction (FIG. 10). As a punch pressure usually exceeds the material flow stress, the billet is exposed to upsetting into the channel and lugs seal the pockets with lubricant. Therefore, contact friction and the pressure on channel walls during ECAE remains low, and simple die design without highly loaded parts can be used.

Figure 13:
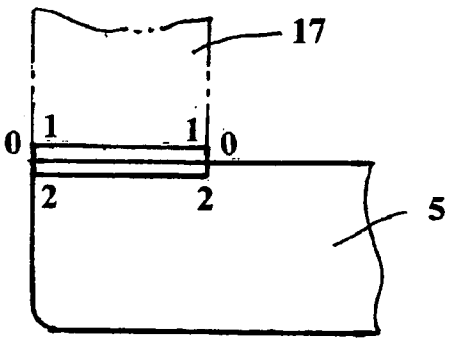
FIG. 13 shows possible varieties of punch impressions at the billet top surface.
Figure 14:
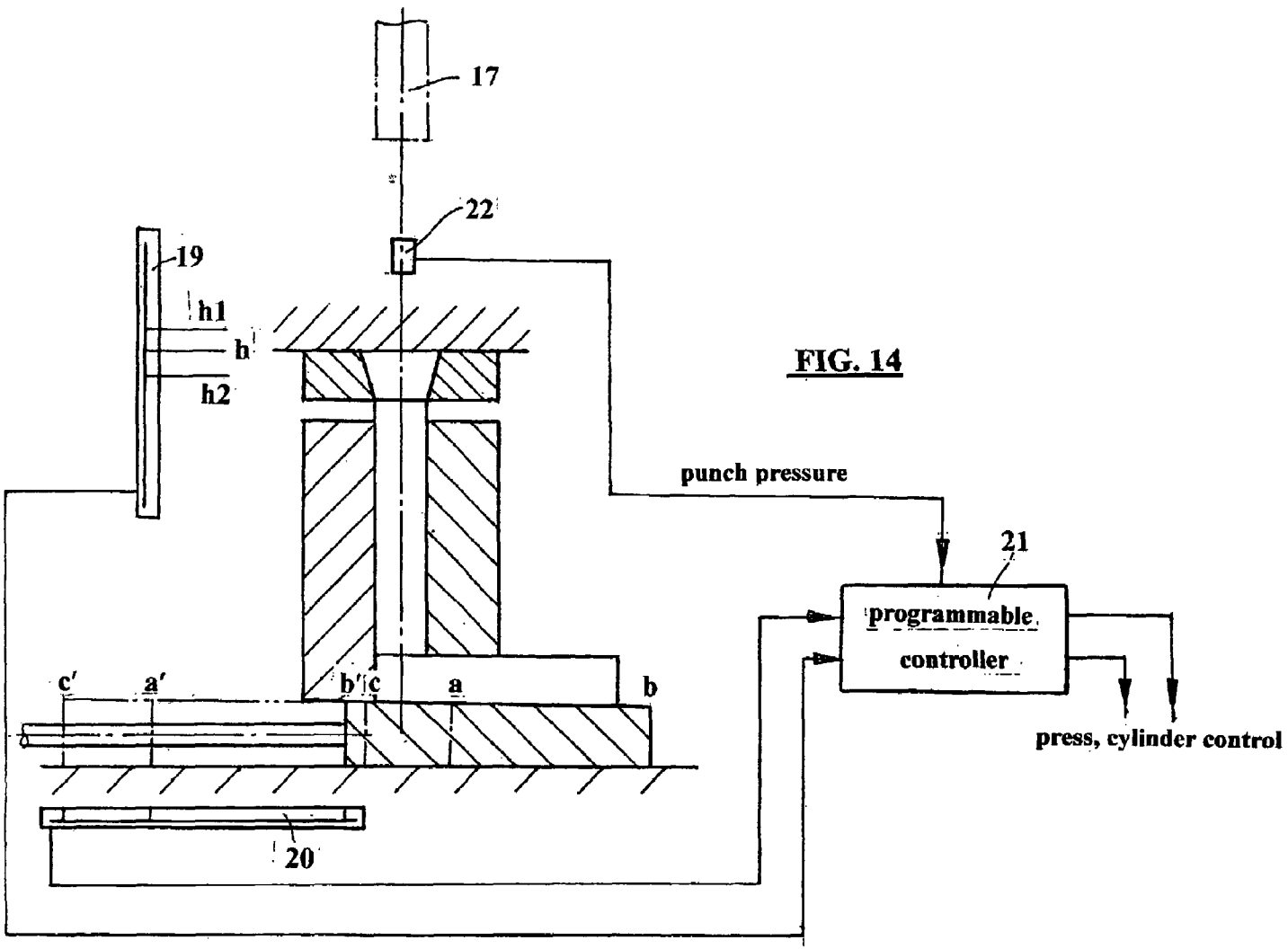
FIG. 14 is a principle diagram of press/die control system.

An additional object of the invention is a control of the working stroke H to provide a flat billet surface after each pass. Severe plastic deformation during multi-pass ECAE leads to very strong material hardening. Usually, the punch pressure increases from 2 to 3 times. That develops a large difference in elastic strains of a press/die system. If the press was fixed for a permanent stroke H, the difference in actual strokes between the first pass and the last pass is from a few millimeters for small billets to dozens of millimeters for large billets. Referring to FIG. 13, it is seen that a punch impressions at the billet top surface may be ranged between projection 1-1 and depression 2-2 instead of flat surface 0-0. Such defects lead to laps or cracks and should be removed after each pass. According to the invention, this problem is solved by special control systems, which operate a press and a slider. Referring to FIG. 14, in one case, the control system comprises a punch position sensor 19, a slider position sensor 20 and a programmable controller 21. Punch positions "h.sub.1" and "h.sub.2" corresponding to the reverse stroke H.sub.1 and to the ejection stroke H.sub.2 (see FIG. 10) as well as the original slider position "a'" and the slider position during ejection "c'" are fixed. However, the punch position "h" corresponding to the working stroke H is variable depending on the billet material, characteristics of processing, stiffness of press/die system and a pass number. Corresponding statistical data providing near flat punch impressions O-O after each pass for certain conditions can be found experimentally and input into the controller 21. The controller operates the press and the slider in accordance with fixed punch positions "h.sub.1", "h.sub.2", fixed slider positions "a'", "c'" and programmed strokes H for each pass.

In another case, an adaptive controller 21 defines the working stroke at each pass automatically. This system comprises additionally a sensor 22 of the punch pressure p mounted in a hydraulic press system and connected to the controller 21. As an elastic displacement of the punch delta is proportion to the pressure p, depending on this pressure at some fixed position near the end of the working stroke the controller 21 defines the actual stroke for any material, pass and conditions. If corrected stroke for some nominal pressure p.sub.0 is (H+.delta.), then actual stroke for any pressure p is (H+.delta.p/p.sub.0). Therefore, only one experimental correction delta. for the punch pressure p.sub.0 should be determined and introduced into the programmable controller for any material and processing conditions.

The invention presents a few important advantages: eliminates cracks, flashes and billet reshaping between passes; provides optimal processing routes to control material structure and properties; reduces contact friction; allows to use more simple and less expensive tool; increases the process productivity. Therefore, multi-pass ECAE becomes a cost-effective industrial operation and may be applied to large flat billets.

I claim:

1. A method of ejecting a billet from a die for equal channel angular extrusion in which a punch is operated by a press, the die comprises a front plate, a back plate, side plates and a slider, a first channel formed between the front plate, the back plate and the side plates and a second channel formed between the front plate, the back plate, the two guide plates and the slider, comprising the steps of: a) performing a working punch stroke from an original punch position to the top level of the second channel; b) performing a retreating punch stroke near the top level of the second channel; c) moving the slider into a direction of a slider original position until full opening of the first channel; d) performing an ejecting punch stroke from the second channel; e) returning the punch to the original position; f) moving the slider to the original position.

2. A method as defined in claim 1 comprising using a slider position sensor, a punch position sensor and a programmable controller operating the press and the hydraulic cylinder, in which the original slider position before extruding and the slider position during ejecting the billet as well as the original punch position, the retreating punch stroke and the ejecting punch stroke are fixed whereas the working punch stroke at each pass is corrected depending on the billet material, processing conditions and the pass number.

3. A method as defined in claim 2 further comprising a sensor of punch pressure during extruding the billet and a programmable adaptive controller, in which the working punch stroke is corrected depending on the punch pressure measured at a fixed punch position near the end of the working stroke.

4. A method as defined in claim 1 further providing side plates with drafts extended into a slider direction under angles from 1 degree to 12 degrees along a thickness of the second channel.

5. A method of ejecting a billet from a die for equal channel angular extrusion in which a punch is operated by a press, the die comprises a front plate, a back plate, side plates and a slider, a first channel formed between the front plate, the back plate and the side plates having drafts extending in a slider direction at an angle from between 12 degrees and 30 degrees along a thickness of the second channel, and a second channel formed between the front plate, the back plate, the two guide plates and the slider, comprising the steps of: a) performing a working punch stroke from an original punch position to the top level of the second channel; b) performing a retreating punch stroke near the top level of the second channel; c) moving the slider into a direction of a slider original position until full opening of the first channel; d) returning the punch to the original position; e) moving the slider to the original position.

* * * * *